US007731345B2

(12) United States Patent
Park et al.

(10) Patent No.: US 7,731,345 B2
(45) Date of Patent: Jun. 8, 2010

(54) SOLID INK JET IMAGE FORMING APPARATUS

(75) Inventors: Sang-cheol Park, Suwon-si (KR); Jeong-yeon Park, Ansan-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 892 days.

(21) Appl. No.: 11/585,252

(22) Filed: Oct. 24, 2006

(65) Prior Publication Data

US 2007/0132821 A1 Jun. 14, 2007

(30) Foreign Application Priority Data

Dec. 8, 2005 (KR) ..... 10-2005-0120228

(51) Int. Cl.
*B41J 2/175* (2006.01)

(52) U.S. Cl. ..... 347/88

(58) Field of Classification Search ..... 347/2, 347/3, 85, 88, 99

See application file for complete search history.

(56) References Cited

U.S. PATENT DOCUMENTS

| | | | | |
|---|---|---|---|---|
| 4,636,803 | A * | 1/1987 | Mikalsen | 347/88 |
| 4,739,339 | A * | 4/1988 | DeYoung et al. | 347/86 |
| 5,341,164 | A * | 8/1994 | Miyazawa et al. | 347/88 |
| 6,053,608 | A | 4/2000 | Ishii et al. | |
| 6,109,803 | A * | 8/2000 | Yasui et al. | 400/320 |
| 6,561,636 | B1 | 5/2003 | Jones | |
| 6,866,375 | B2 | 3/2005 | Leighton et al. | |
| 6,905,201 | B2 | 6/2005 | Leighton | |
| 2004/0114010 | A1 | 6/2004 | Leighton et al. | |

FOREIGN PATENT DOCUMENTS

| | | |
|---|---|---|
| EP | 0820873 A2 | 1/1998 |
| JP | 10-34957 | 2/1998 |
| JP | 10-34959 | 2/1998 |
| JP | 2004-90614 | 3/2004 |
| JP | 2004-114363 | 4/2004 |
| KR | 1998-17878 | 6/1998 |

OTHER PUBLICATIONS

Office Action issued in Korean Patent Application No. 2005-120228 on Nov. 21, 2006.

Chinese Office Action dated Nov. 28, 2009, issued in corresponding Chinese Patent Application No. 200610166703.7.

* cited by examiner

*Primary Examiner*—Anh T. N. Vo

(57) ABSTRACT

A solid ink jet image forming apparatus includes a printing unit which fires melted solid ink onto an image on a printing medium for printing, and an ink supplying unit which contains solid ink in a lateral direction of the printing unit. In the case where the solid ink jet image forming apparatus includes a scanning unit reading an image from a document, a user can simply and easily load the solid ink without moving the scanning unit, so that the solid ink jet image forming apparatus has improved installation stability and a compact size.

29 Claims, 7 Drawing Sheets

SOLID INK JET IMAGE FORMING APPARATUS

CROSS-REFERENCE TO RELATED APPLICATION

This application claims the benefit of Korean Patent Application No. 2005-120228, filed on Dec. 8, 2005, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a solid ink jet image forming apparatus that forms an image by melting solid ink and firing the melted ink onto a printing medium.

2. Description of the Related Art

Generally, image forming apparatuses print an image onto a printing medium, such as paper or OHP (overhead projector) film. Examples of image forming apparatuses include printers, copiers, and facsimile machines, along with multifunction apparatuses which combine the functions of these devices. Image forming apparatuses are classified in various ways, such as, for example, as an electrophotographic type image forming apparatuses, ink jet type image forming apparatuses, dye sublimation type image forming apparatuses, etc. In the ink jet type image forming apparatus, an ink jet image forming apparatus that forms an image by melting solid ink and firing the melted ink onto a printing medium is called a "solid ink jet image forming apparatus."

The solid ink is manufactured by mixing resin with ink and forming a block which has a predetermined size. The solid ink is in a solid state at room temperature and converts to a liquid state when heated. The solid ink jet image forming apparatus includes an ink supplying unit which contains solid ink and which melts the solid ink to supply the melted ink for printing, and a printing unit which receives the melted ink from the ink supplying unit and which fires the melted ink onto a printing medium to form an image.

A conventional method for loading the solid ink will now be described. A media output tray disposed on an upper portion of an image forming apparatus receives the printing media after printing. The media output tray includes a door which opens an ink supplying unit. The ink supplying unit is exposed to the outside by opening the door upward after removing the printing media from the media output tray. Then, solid ink is inserted into the exposed ink supplying unit.

If the image forming apparatus is a multifunction apparatus with a scanner function, the image forming apparatus includes a scanning unit, an ink supplying unit, and a printing unit. Generally, the image forming apparatus is opened by rotating the scanning unit. If a door is provided between the scanning unit and the ink supplying unit, the scanning unit is rotated to expose the door and then the door is opened to insert solid ink into the ink supplying unit.

For convenience, a wide area of the top of the image forming apparatus should be exposed to load the solid ink. After the solid ink is inserted, the door is closed for printing. The above-described solid ink loading method should be improved to make the process of loading solid ink into the image forming apparatus more simple for users. Furthermore, foreign substances may fall into the image forming apparatus when the door is opened.

Furthermore, since the addition of the ink supplying unit increases the size of the image forming apparatus, the packing size of the image forming apparatus increases, causing a corresponding increase in physical distribution costs. Therefore, an ink supplying unit and an image forming apparatus with reduced sizes are desirable.

The scanning unit includes a flat glass plate to place a document on, an image sensor disposed under the flat glass to scan the document, and a driving unit which moves the image sensor. The scanning unit considerably increases the weight of the image forming apparatus. Generally, a hinge is provided in a top corner of the image forming apparatus to rotate the scanning unit. When the scanning unit is rotated to insert the solid ink, the center of mass of the scanning unit moves in the direction approaching the outside of the printing unit, thereby increasing the possibility of damage to the image forming apparatus due to overturning of the image forming apparatus.

SUMMARY OF THE INVENTION

Aspects of the present invention provide an image forming apparatus that has an improved solid ink supplying unit so that a user can conveniently load solid ink into the solid ink supplying unit.

Aspects of the present invention provide an improved solid ink supplying unit which reduces the size of the image forming apparatus.

According to aspects of the present invention, when the image forming apparatus includes a scanning unit, the solid ink is loaded without needing to rotate the scanning unit off of the image forming apparatus and change the center of mass.

According to an aspect of the present invention, there is provided a solid ink jet image forming apparatus including a printing unit which fires melted solid ink to print an image onto a printing medium, a scanning unit installed above the printing unit to project light which reads an image from a document, and an ink supplying unit which contains solid ink and which melts the solid ink to supply the melted solid ink to the printing unit, the ink supplying unit being provided under the scanning unit and openable from a lateral side of the printing unit when the solid ink is loaded.

According to another aspect of the present invention, there is provided a solid ink jet image forming apparatus including a printing unit which fires melted solid ink to print an image onto a printing medium, and an ink supplying unit which contains solid ink and which melts the solid ink to supply the melted solid ink to the printing unit, the ink supplying unit being openable from a lateral side of the printing unit when the solid ink is loaded.

According to an aspect of the invention, the ink supplying unit includes a containing portion which contains at least one piece of solid ink, a heating plate which melts the solid ink, and a loader which reciprocates in a lateral direction of the printing unit to open and close the containing portion.

According to an aspect of the invention, the ink supplying unit further includes a supplying portion which supplies the melted solid ink to the printing unit, and a pressing plate which elastically presses the solid ink against the heating plate when the loader is inserted into the printing unit, and departs from the solid ink when the loader is pulled toward an outside of the printing unit.

According to an aspect of the invention, the ink supplying unit further includes a roll spring connected with the pressing plate to provide an elastic force which pulls the pressing plate toward the heating plate.

According to an aspect of the invention, cyan, magenta, yellow, and black ink supplying units are provided for cyan, magenta, yellow, and black colors.

According to an aspect of the invention, the loader includes insertion holes through which the solid ink is loaded.

According to an aspect of the invention, the insertion holes have different shapes corresponding to the cyan, magenta, yellow, and black colored solid inks.

According to an aspect of the invention, the insertion hole is defined in the loader at a predetermined position, such that the insertion hole is positioned in front of the pressing plate when the pressing plate is moved rearward when a user pulls the loader.

According to an aspect of the invention, the loader is formed as one piece for cyan, magenta, yellow, and black colored solid inks.

According to an aspect of the invention, the solid ink jet image forming apparatus further includes a door which closes and opens at the lateral side of the printing unit to allow the loader to move inside and outside of the printing unit.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become more apparent and more readily appreciated from the following description of the embodiments, taken in conjunction with the accompanying drawings of which.

DETAILED DESCRIPTION OF THE EMBODIMENTS

Figure 1:
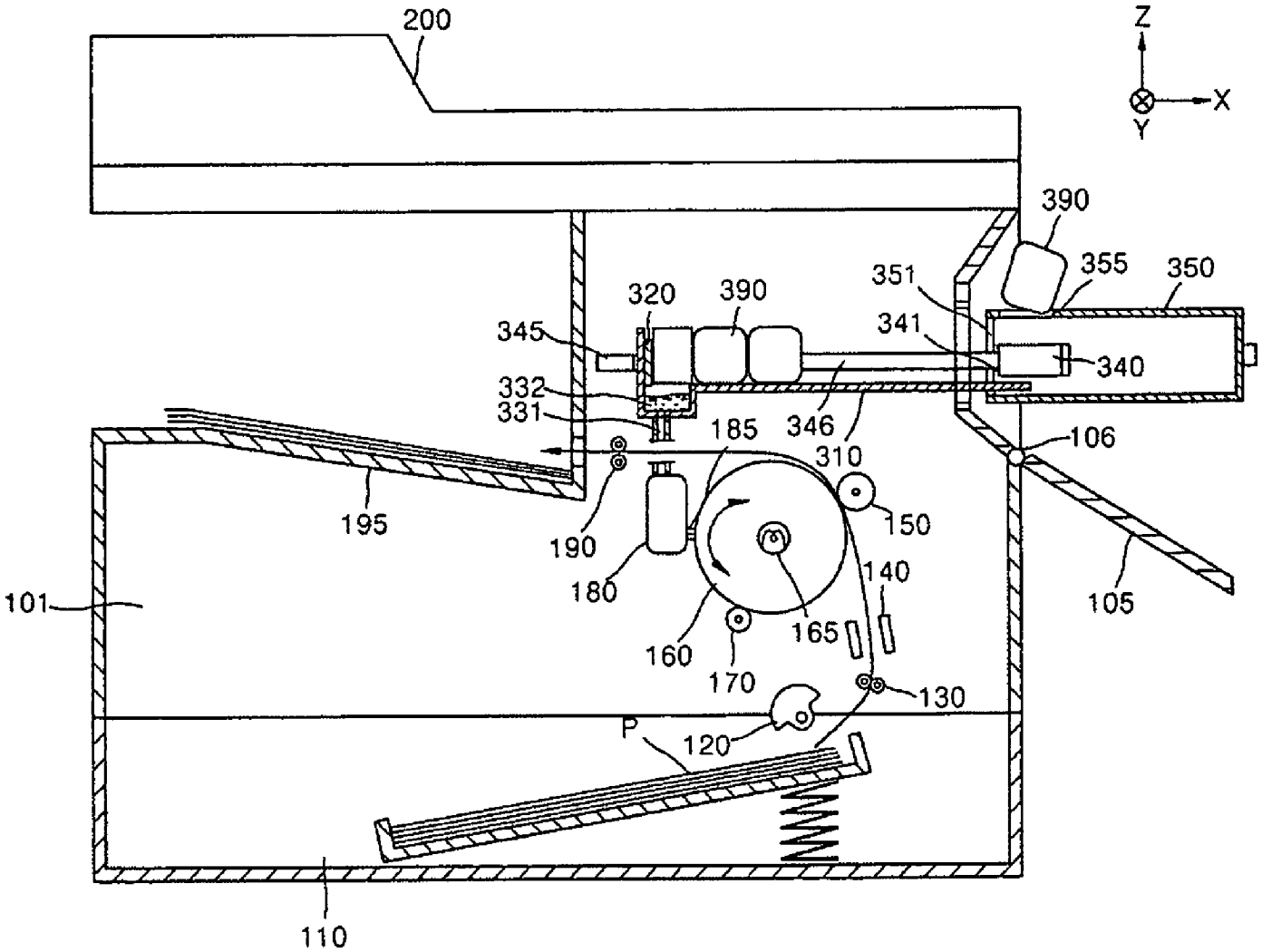
FIG. 1 is a side sectional view of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
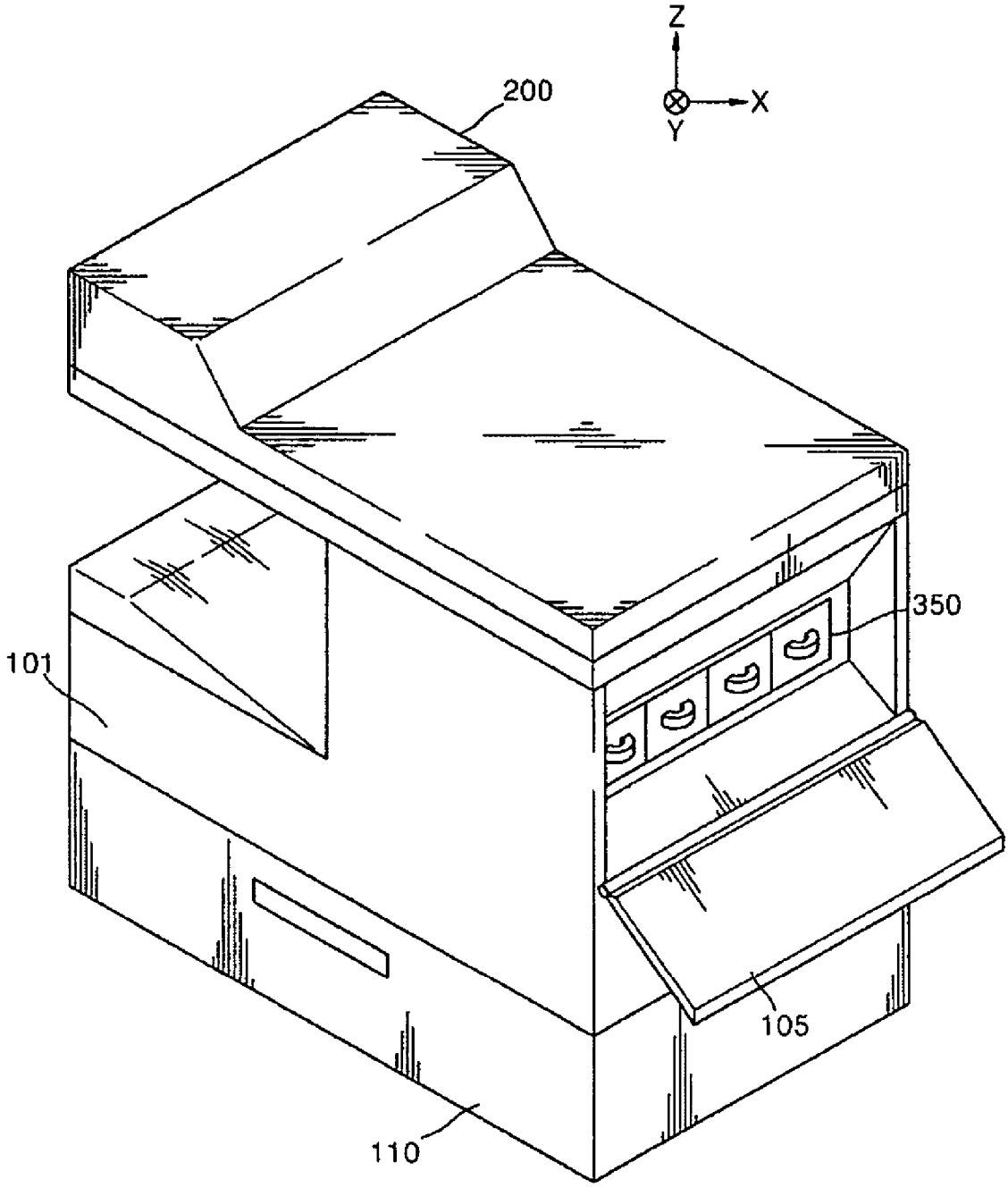
FIG. 2 is a perspective view of an image forming apparatus when a loader is inserted into the image forming apparatus according to an embodiment of the present invention.
Figure 3:
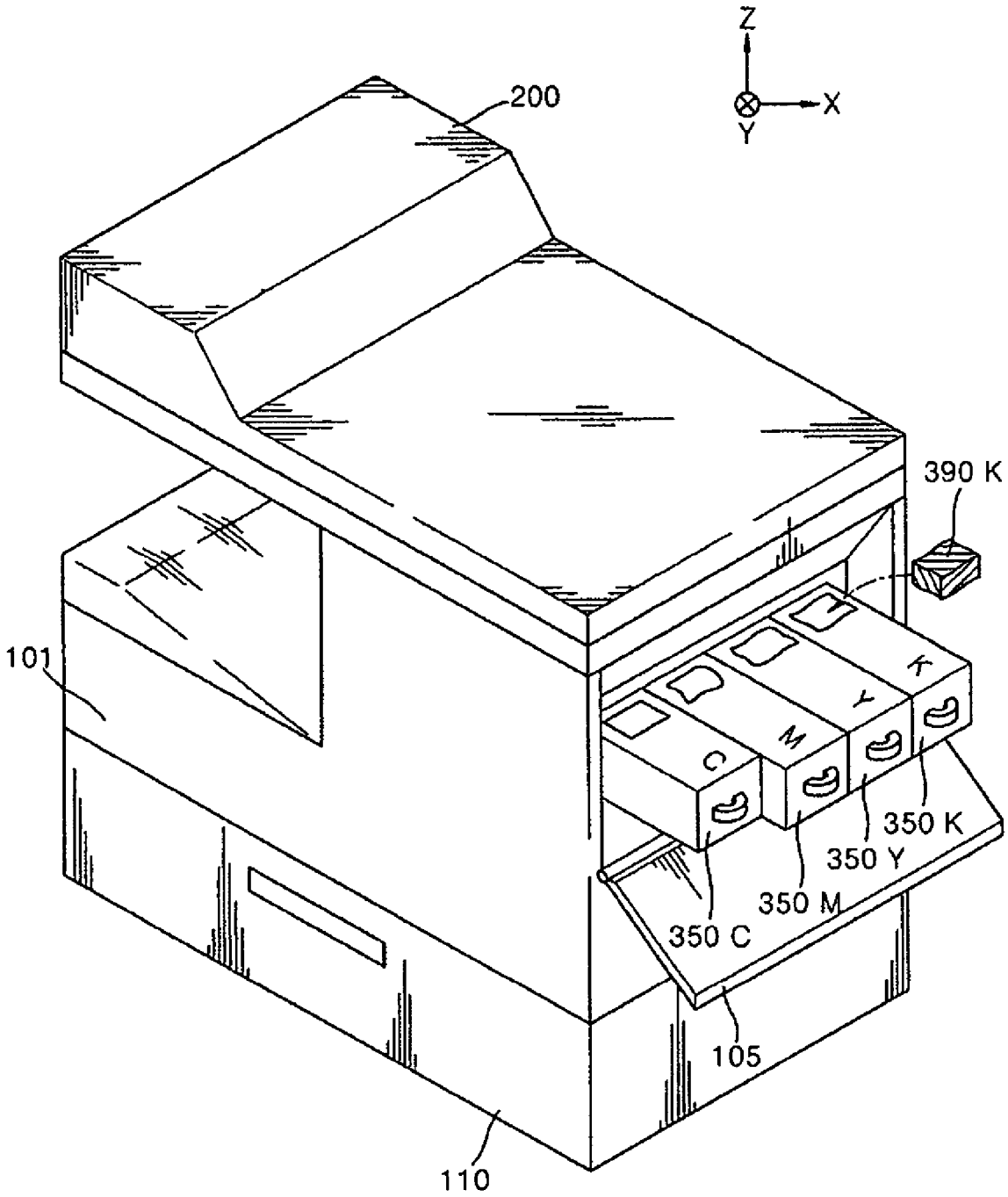
FIG. 3 is a perspective view of an image forming apparatus when a loader is pulled from the image forming apparatus according to an embodiment of the present invention.
Figure 4:
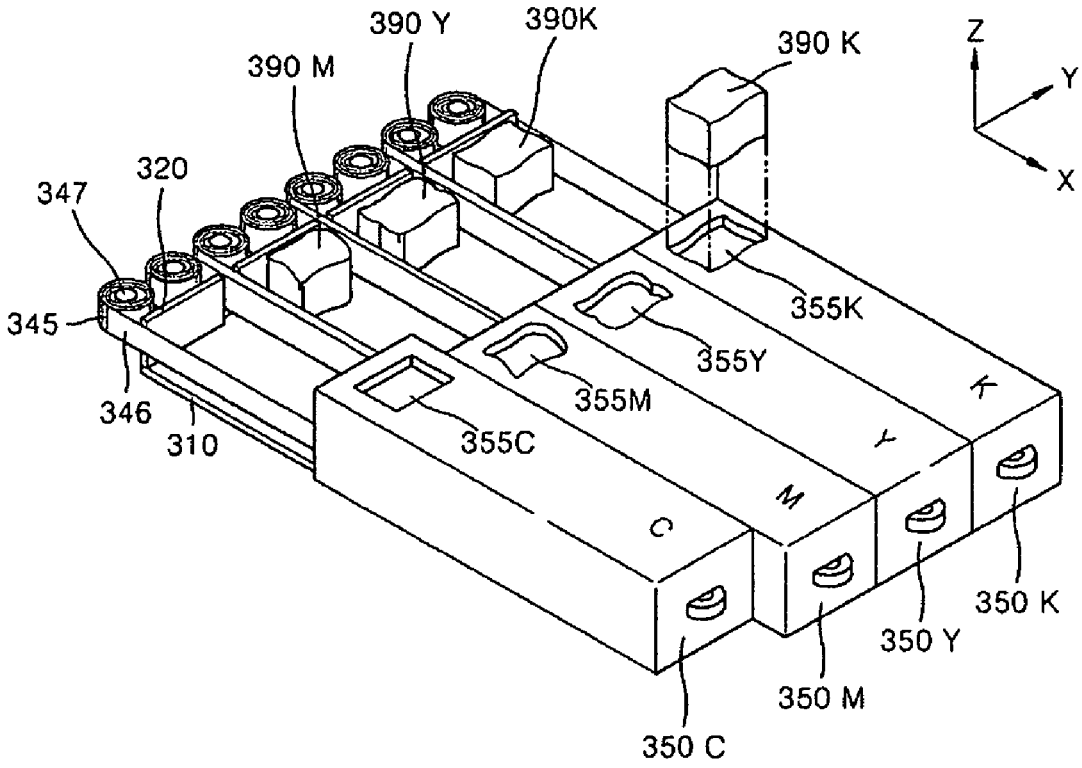
FIG. 4 is a perspective view of an ink supplying unit when a loader is pulled from the ink supplying unit according to an embodiment of the present invention.

FIG. 1 is a side sectional view of an image forming apparatus according to an aspect of the present invention, FIG. 2 is a perspective view of the image forming apparatus depicted in FIG. 1 when a loader 350 is inserted into the image forming apparatus, FIG. 3 is a perspective view of the image forming apparatus depicted in FIG. 1 when the loader 350 is pulled from the image forming apparatus, and FIG. 4 is a perspective view of an ink supplying unit when the loader 350 is pulled from the ink supplying unit according to the present invention. An embodiment of the present invention will now be described with reference to FIGS. 1 through 4.

Referring to FIGS. 1 and 2, the image forming apparatus of an embodiment of the present invention is shown as a multifunction apparatus. The multifunction apparatus includes a printing unit 101, a scanning unit 200, and an ink supplying unit. Though not shown, an image forming apparatus without the scanning unit 200 may also be an embodiment of the image forming apparatus of the present invention. Descriptions given below are common for image forming apparatuses. Additionally, while described as a scanning unit 200, a copier and/or facsimile unit may be used instead of or in addition to the scanning unit 200.

The ink supplying unit melts solid ink 390 and supplies the melted solid ink 390 to the printing unit 101. The printing unit 101 fires the melted solid ink 390 onto a printing medium (P) to print an image. The printing unit 101 includes a cassette 110, a pick-up roller 120, feed rollers 130, a transfix roller 150, a drum 160, a maintenance roller 170, an ink jet cartridge 180, and eject rollers 190. This drum 160 may be a photosensitive drum. However, it is understood that the printing unit 101 can be otherwise constructed.

Generally, liquid ink is absorbed into the printing medium (P) to form an image on the printing medium (P). For example, printing quality is high when printing an image on paper using liquid ink since the fiber of the paper absorbs liquid ink well. On the other hand, however, printing quality is poor when printing an image onto OHP film by firing liquid ink onto the OHP film, since the OHP film absorbs the liquid ink poorly. Therefore, in order to print a high quality image, the user can only use a limited variety of printing media. Furthermore, after the liquid ink is fired, remaining ink may flow down around a nozzle or stick to the periphery of the nozzle due to the relatively low viscosity of the liquid ink, thereby causing the nozzle to be contaminated or choked up.

According to an aspect of the invention, the solid ink 390 is formed out of a mixture including wax, resin, ink, and/or other additives. The solid ink 390 maintains a solid state at a room temperature. For example, the solid ink 390 has a softening point ranging from 40° C. to 140° C., a melting point ranging from 50° C. to 150° C., and a high viscosity when melted. When heated, the solid ink 390 having wax or resin is converted into a liquid state. When this melted liquid ink 390 is fired onto the printing medium (P), the liquid ink 390 adheres to the surface of the printing medium (P) and rapidly converts back to a solid state. Therefore, a high printing quality is attained using the solid ink 390, even when printing on a printing medium (P) having a smooth surface such as an OHP film. An ink supplying passage and ink firing nozzles are kept at a heated state to prevent the melted solid ink 390 from solidifying, thereby lowering the possibility of nozzle clogging or other problems. While described as using wax and/or resin to increase viscosity, it is understood that other additives can be used to increase viscosity.

However, when the melted solid ink 390 is fired from a nozzle to the printing medium (P), the melted solid ink 390 becomes solid immediately after the melted solid ink 390 reaches the surface of the printing medium (P). As a result of turning solid immediately, the solid ink 390 is stacked onto the printing medium (P) to a relatively high height. Therefore, when the printing medium (P) is rubbed after printing, ink dots formed on the printing medium (P) wear off easily, and the adhesion strength of the solid ink 390 may also be lowered. Furthermore, thick ink dots stacked on a printing medium (P), such as OHP film, scatters light and makes the printed image unclear. When printing a color image, ink of different colors, such as cyan (C), magenta (M), yellow (Y), and black (K), are fired to the same dot. In this case, if the cyan (C), magenta (M), yellow (Y), and black (K) ink are solidified at different times while they cool respectively, color registration error causes a reduction in printing quality. To eliminate these problems, an intermediate transfer unit, such as the drum 160, is used.

The drum 160 is rotatably installed in the printing unit 101. The drum 160 includes a heat source 165 located inside the drum 160. This heat source 165 may be a halogen lamp, although it may also be many other types of heat sources. Through not shown, light emitted from the halogen lamp is converted into heat by a photothermal layer formed onto an inner surface of the drum 160 to heat an outer surface of the drum 160 to a predetermined temperature.

The ink jet cartridge 180 is detachably installed inside the printing unit 101. When the lifetime of the ink jet cartridge 180 expires, the expired ink jet cartridge 180 is replaced with a new ink jet cartridge. During printing, the ink jet cartridge 180 receives melted ink 390 and fires ink droplets onto the outer surface of the drum 160 through a nozzle unit 185.

To prevent rapid solidification of the melted ink 390, an ink supplying passage defined from the ink supplying unit to the nozzle unit 185 and the outer surface of the drum 160 are heated and insulated to keep their temperatures at a predetermined level. When viewed from a microscopic perspective of an ink dot size, ink droplets fired from the nozzle unit 185 to the outer surface of the drum 160 are spread to an area on the outer surface of the drum 160 which is relatively wide compared to the area of these ink dots on the printing medium (P). As described above, the ink droplets rapidly solidify when fired directly onto a printing medium (P). However, when the drum 160 is used during printing operations, the ink droplets fired onto the drum 160 solidify at a thin thickness level and are not rapidly solidified, compared to when the ink droplets are fired directly onto the printing medium (P).

In an embodiment, the ink jet cartridge 180 fires melted ink 390 along a main scanning direction (y-axis) at one time. According to an aspect of the present invention, the nozzle unit 185 includes a plurality of nozzles along the main scanning direction over the width of the printing medium (P). When a color image is printed, ink of different colors, such as cyan (C), magenta (M), yellow (Y), and black (K), are fired simultaneously. The use of these different ink colors increases the speed of color printing operations to the same speed as printing operations during monochromatic printing. However, other number of nozzles and/or colors can be used in other aspects of the invention.

After ink droplets corresponding to one page are fired onto the outer surface of the drum 160, the ink 390 is transferred from the drum 160 to the printing medium (P). When the ink 390 is transferred to the printing medium (P), temperature deviation between thick ink and thin ink print areas on the printing medium (P) is reduced if the length of the drum 160 is approximately the same length as the width of the printing medium (P). Furthermore, for example, when images are printed based on A4 size, the outer surface of the drum 160 may be larger than the A4 size. In this case, after ink droplets corresponding to an A4-size page are fired to the drum 160, an ink image corresponding to the A4-size page is transferred from the drum 160 to a printing medium (P) in one step.

In an embodiment, while rotating clockwise, the drum 160 receives the melted ink 390 on its outer surface. The maintenance roller 170 makes contact with the outer surface of the drum 160 before the melted ink 390 is fired onto the outer surface of the drum 160 to coat the drum 160 with a release agent, such as oil. When an ink image formed on the drum 160 by the fired ink droplets is transferred to a printing medium (P), the release agent facilitates separation of the ink image from the drum 160.

After ink droplets corresponding to one page are fired onto the outer surface of the drum 160, a printing medium (P) is fed into a passage inside of the image forming apparatus. In the shown example, the printing medium (P) is stored in the cassette 110 which is detachably installed onto the printing unit 101. Among printing media (P) stacked in the cassette 110, the pick-up roller 120 picks up the upper most printing medium (P) from the cassette 110 and feeds it to the feed rollers 130. The feed rollers 130 feed the printing medium (P) between the drum 160 and the transfix roller 150. However, it is understood that the printing medium (P) can be otherwise fed and/or stored, such as in a tray.

A preheating unit 140 heats up the printing medium (P) before the ink image is transferred to the printing medium (P), so that the ink image is prevented from rapidly solidifying when transferred onto the printing medium (P). While the ink image is transferred to the printing medium (P), the printing medium (P) is fed toward the eject rollers 190. The eject rollers 190 discharge the printing medium (P) to an output tray 195 disposed on an outer side of the printing unit 101. However, it is understood that the tray 195 can be otherwise located.

The transfix roller 150 is heated up to a predetermined temperature and begins rotating while making contact with the drum 160 by pressure. Transferring and fusing of the ink image are simultaneously performed between the drum 160 and the transfix roller 150. In an embodiment, when the drum 160 and other rollers are disposed as shown in FIG. 1, the drum 160 receives ink droplets which form an ink image on an outer surface of the drum 160 as it rotates clockwise. After the ink image is completely formed onto the drum 160, the drum 160 switches directions and rotates counterclockwise to transfer the ink image to the printing medium (P).

If the image forming apparatus includes a scanning unit, such as the scanning unit 200, the scanning unit 200 is installed above the printing unit 101, as shown in FIG. 1. Though not shown, the scanning unit 200 includes an auto document feeder (ADF), a light source, a mirror, a lens unit, and an image sensor. The scanning unit 200 scans a document with light to obtain an image signal. The image signal is converted into an electrical signal by the image sensor, and then the electrical signal is sent directly to the printing unit 101, and/or, the electrical signal is sent to a computer connected to the printing unit 101. It is understood that the scanner 200 can be otherwise constructed and need not use the ADF in all aspects.

The ink supplying unit stores the solid ink 390 and melts the solid ink 390 to supply it to the printing unit 101. In an embodiment, the ink supplying unit is positioned above the printing unit 101. If the image forming apparatus is a multifunction apparatus having the scanning unit 200 on the top of the image forming apparatus, the ink supplying unit is positioned between the scanning unit 200 and the printing unit 101. A user can open the ink supplying unit from the side of the printing unit 101 to replace the solid ink 390. According to this structure, the height of the printing unit 101 is reduced, and the overall size of the image forming apparatus is therefore also reduced. Additionally, since a user can load the solid ink 390 into the ink supplying unit without moving the scanning unit 200, the process of replacing the solid ink 390 is much more convenient for the user.

As shown in FIG. 1, the ink supplying unit according to an embodiment of the present invention includes a containing portion 310, a heating plate 320, and a loader 350. The ink supplying unit may further include a supplying portion 330 and a pressing plate 340. In this embodiment, the containing portion 310 has a plate shape and is fixed to the printing unit 101. The containing portion 310 may have other shapes and does not have to be fixed to the printing unit 101. The containing portion 310 receives at least one piece of solid ink 390 from a user. The heating plate 320 is positioned on one side of the containing portion 310. The heating plate 320 makes contact with the solid ink 390 to melt the solid ink 390 and supply the melted ink 390 to the supplying portion 330. The supplying portion 330 receives the melted ink 390 from the heating plate 320 and supplies the melted ink 390 to the printing unit 101.

While not required in all aspects, the shown supplying portion includes a storing bin 332 and a supplying path 331, although other configurations of the supplying portion are possible. The storing bin 332 temporarily stores the melted ink 390 received from the heating plate 320. The storing bin 332 is connected to the supplying path 331. The storing bin 332 is heated to and then maintained at a predetermined temperature, to prevent the melted ink 390 inside the storing bin 332 from solidifying. The supplying path 331 connects the storing bin 332 to the ink jet cartridge 180.

The pressing plate 340 is positioned on the side of the containing portion 310 opposite to the heating plate 320 to press the solid ink 390 against the heating plate 320. Both sides of the at least one piece of the solid ink 390 are pressed by the heating plate 320 and the pressing plate 340. The pressing plate 340 is connected to an elastic member that pulls the pressing plate 340 towards the heating plate 320.

Many different types of elastic members may be used to effectively bias the ink 390 towards the heating plate 320. The elastic member may be for example, a roll spring 345. As shown in FIGS. 4-9, roll springs 345 may be positioned on each side of each loader 350. A spring (not shown) is provided on a shaft 347 of the roll spring 346 to provide an elastic force which winds a band 346. The band 346 is wound around the shaft 347 and has one end fixed to the shaft 347 and the other end fixed to the pressing plate 340. The band 346 is properly configured so that the band 346 does not interfere with the relative movement between the loader 350 and the containing portion 310. The elastic member of embodiments of present invention is not limited to being the roll spring 345. Any type of elastic member capable of pulling the pressing plate 340 may effectively work in embodiments of the present invention.

Figure 5:
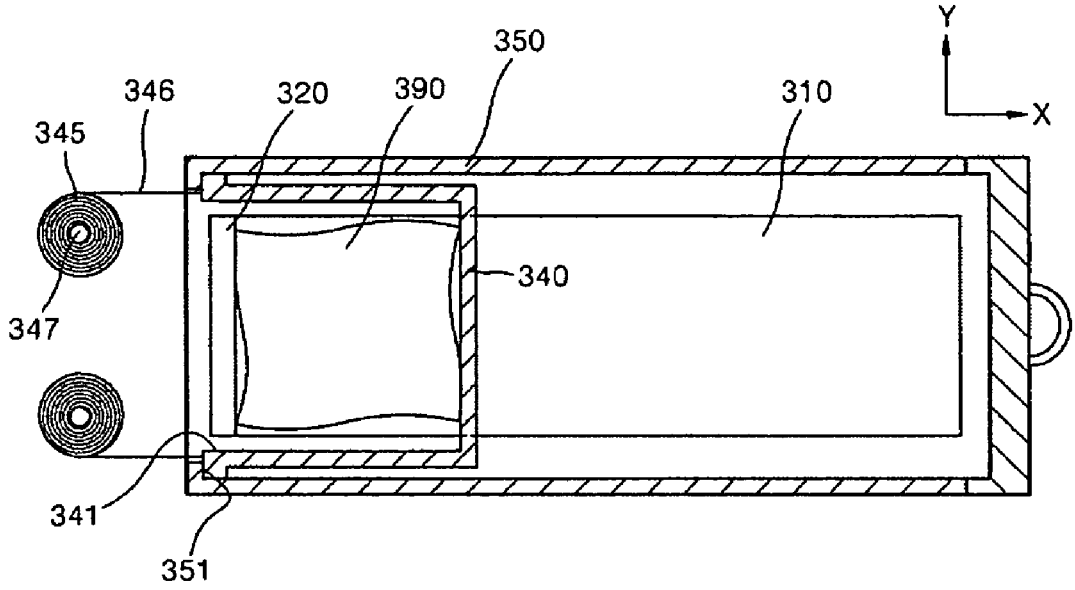
FIG. 5 is a sectional view taken along a horizontal plane which shows an ink supplying unit when one piece of solid ink is loaded in the ink supplying unit according to an embodiment of the present invention.
Figure 6:
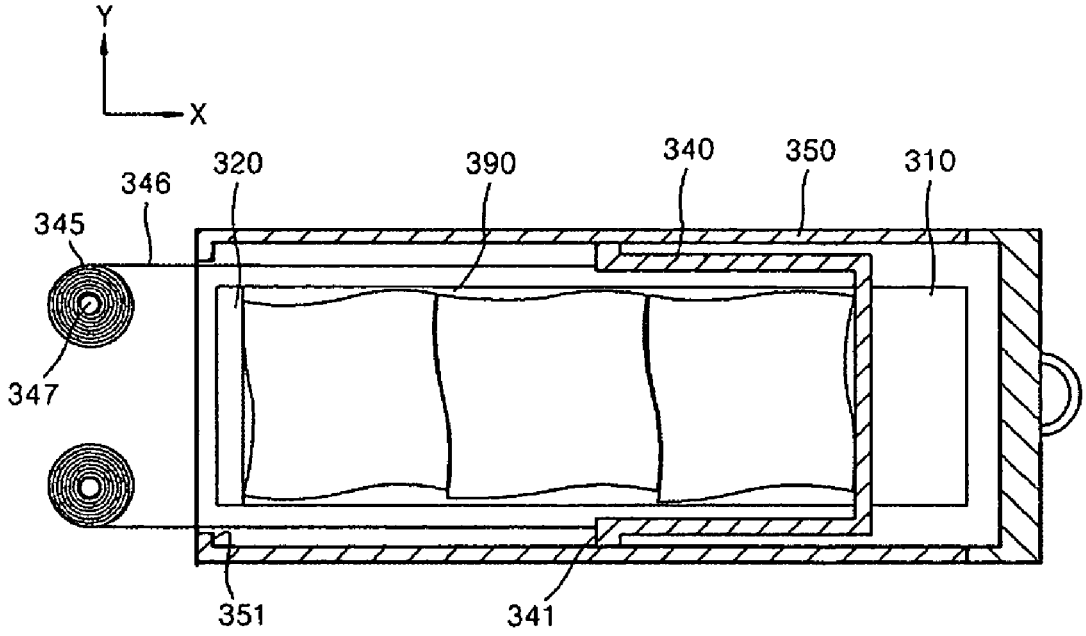
FIG. 6 is a sectional view taken along a horizontal plane which shows an ink supplying unit when two or more pieces of solid ink are loaded in the ink supplying unit according to an embodiment of the present invention.

The loader 350 is movable along the containing portion 310 in a lateral direction of the printing unit 101. The loader 350 and the pressing plate 340 are connected by a linking member to facilitate simultaneous motion, so that the loader 350 is pulled towards the heating plate 320 along with the pressing plate 340 when the pressing plate 340 is pulled towards the heating plate 320. As an example of the linking member, stop portions 341 and 351, as shown in FIG. 5, are formed onto the pressing plate 340 and the loader 350, respectively. When the elastic member elastically pulls the pressing plate 340 towards the heating plate 320, the stop portion 341 of the pressing plate 340 contacts the stop portion 351 of the loader 350, causing the loader 350 to be elastically pulled toward the heating plate 320 by the elastic member. As shown in FIGS. 5-6, when the loader 350 is pulled in a direction along the x-axis against the elastic force pulling the loader 350 toward the heating plate 320, the containing portion 310 is opened. The top of the loader 350 may have a permanent opening so that a user can easily and conveniently load the solid ink 390 into the loader 350. The top of the loader 350 may also have a cover (not shown) which the user opens to insert the solid ink 390 into the loader 350. Other configurations are also possible.

A color image forming apparatus includes cyan, magenta, yellow, and black ink supplying units, each of these supplying units having a containing portion 310, a heating plate 320, a supplying portion 330, a pressing plate 340, a loader 350, and a roll spring 345. If a plurality of loaders 350C, 350M, 350Y, and 350K are provided in each of the respective color ink supplying units, each top of the four different loaders 350C, 350M, 350Y, and 350K may have a unique shape as an opening. Insertion holes 355C, 355M, 355Y, and 355K may be defined in portions of the tops of the loaders 350C, 350M, 350Y, and 350K so that each of these four differently shaped insertion holes 350C, 350M, 350Y, and 350K corresponds to a different color of solid ink 390C, 390M, 390Y, and 390K. A user can therefore load the solid ink 390C, 390M, 390Y, and 390K into proper loaders 350C, 350M, 350Y, and 350K without any confusion. The solid ink 390C, 390M, 390Y, and 390K may also be formed to have different shapes corresponding to their colors, and the insertion holes 355C, 355M, 355Y, and 355K may be correspondingly defined to match these four different shapes, so that only the correct color of ink fits into the correct insertion hole. While shown as cyan, magenta, yellow and black, it is understood that other colors and/or numbers of loaders per color can be used.

When the loader 350 is pulled by a user, the pressing plate 340 is moved to a rearward position in the direction of the x-axis by the stop portion 351 of the loader 350. The insertion hole 355 may be located so that the insertion hole 355 is located to the side of the pressing plate 340 when the pressing plate 340 is moved in the direction of the x-axis. This way, a user can load the solid ink 390 into the insertion hole 355 without being hindered by the pressing plate 340, because the pressing plate 340 is located off to the side of the insertion hole 355. When the loader 350 is pulled, the containing portion 310 is exposed to the outside of the printing unit 101 through the insertion hole 355, and the user inserts new solid ink 390 through the insertion hole 355.

After the user loads the solid ink 390 into the loader 350 and releases the loader 350, the elastic member elastically pulls the loader 350 and the pressing plate 340 back inside the printing unit 101 along the direction of the −x-axis. Then, the pressing plate 340 presses the solid ink 390 against the heating plate 320. After the loader 350 is fully inserted into the printing unit 101, the user may then close a door 105. The door 105 is hinged onto a lateral side of the printing unit 101 to close or open the ink supplying unit. The user may close the door 105 to protect the ink supplying unit, and open the door 105 to expose the ink supplying unit and load a new solid ink 390 into the loader 350. The user may close and open the door 105 manually, or the door 105 may be designed to close automatically when the elastic member pulls the loader 350 back inside the image forming apparatus, such as, for example, by connecting a spring (not shown) to the loader 350 and the door 150 so that when the loader 350 is pulled inside the image forming apparatus by the elastic member, the spring pulls the door 105 closed automatically.

While not required, the printing unit 101 may further include a jammed medium removing door (not shown) which the user can use to remove jammed recording medium (P). The jammed medium removing door exposes the printing medium feeding passage in the printing unit 101 to the outside when the user opens the jammed medium removing door. In an embodiment, the door 105 may function as the jammed medium removing door.

While not required, the printing unit 101 may further include a part replacement door (not shown) which provides the user with access to inside consumable parts for replacement purposes. The consumable parts are exposed by opening the part replacement door. In an embodiment, the door 105 may function as the part replacement door.

Figure 7:
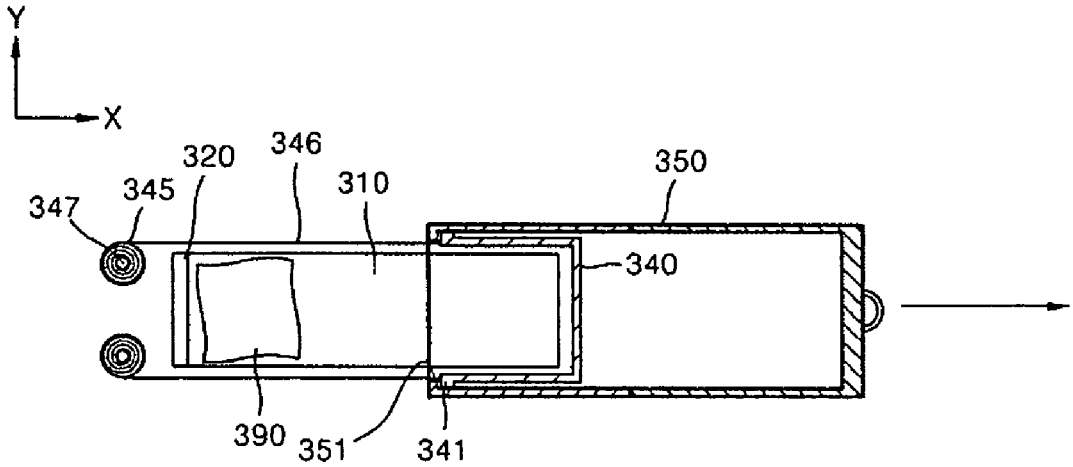
FIG. 7 is a sectional view taken along a horizontal plane which shows an ink supplying unit when a loader is pulled from the ink supplying unit according to an embodiment of the present invention.
Figure 8:
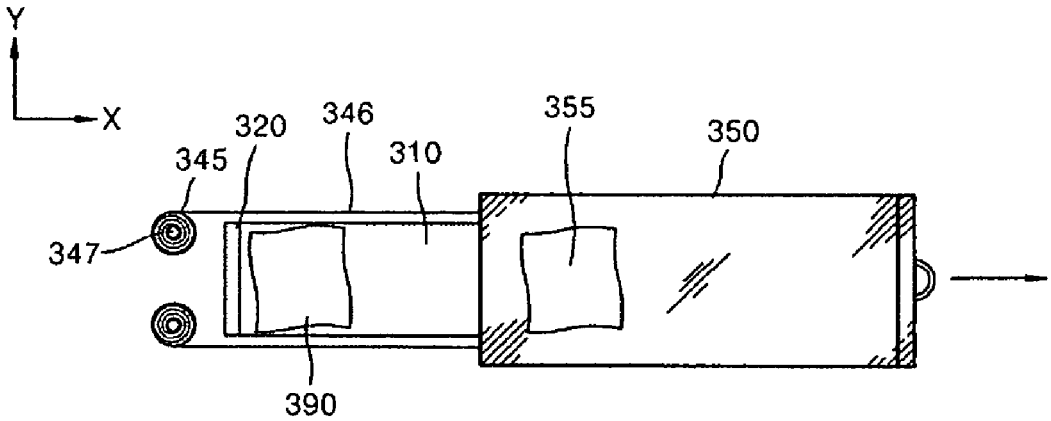
FIG. 8 is a plan view of an ink supplying unit when a loader is pulled from the ink supplying unit according to an embodiment of the present invention.

FIG. 5 is a sectional view taken along a horizontal plane to show an ink supplying unit when one piece of solid ink 390 is loaded in the ink supplying unit therein according to an aspect of the present invention, FIG. 6 is a sectional view taken along a horizontal plane to show the ink supplying unit depicted in FIG. 5 when two or more pieces of solid ink 390 are loaded in the ink supplying unit, FIG. 7 is a sectional view taken along a horizontal plane to show the ink supplying unit depicted in FIG. 5 when the loader 350 is pulled from the ink supplying unit, and FIG. 8 is a plan view of the ink supplying unit depicted in FIG. 5 when the loader 350 is pulled from the ink supplying unit.

Referring to FIGS. 5 through 8, the loader 350 is filled with the solid ink 390. At least one piece each of cyan, magenta, yellow, and black solid ink 390C, 390M, 390Y, and 390K is loaded into the loader 350. Multiple pieces of each color ink may also be loaded into the loader 350, as shown in FIG. 6. One side of the solid ink 390 makes contact with the heating plate 320, and the other side of the solid ink 390 makes contact with the pressing plate 340. When the elastic member pulls the loader 350, the stop portions 341 and 351 cause the pressing plate 340 to simultaneously move in connection with the loader 350.

Figure 9:
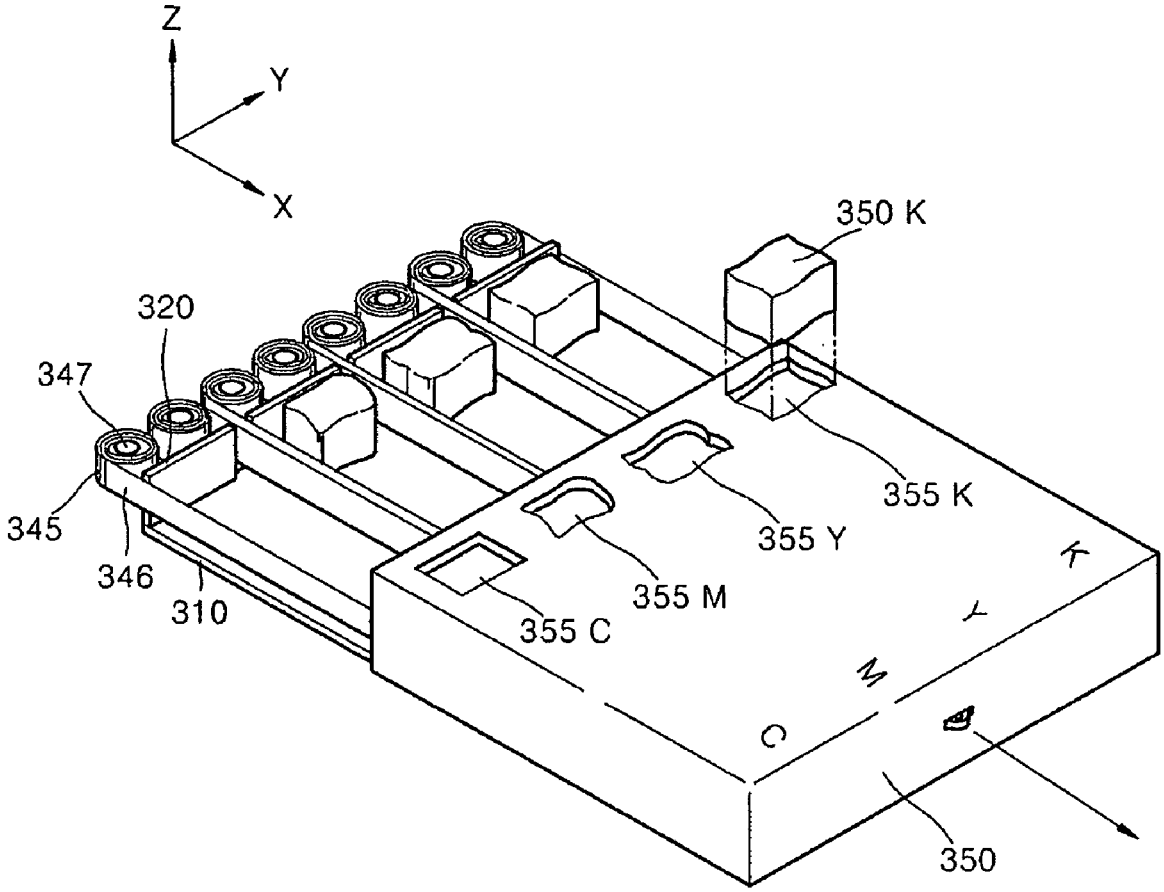
FIG. 9 is a perspective view of an integrated loader according to another embodiment of the present invention.

FIG. 9 is a perspective view of an integrated loader according to another embodiment of the present invention. Since the loader 350 moves the pressing plate 340 in a backwards direction (along the x-axis in FIG. 9) when a user opens the containing portion 310, the loader 350 can be formed as one piece, instead of four separate pieces corresponding to the four separate colors of the solid ink 390. In this embodiment, the loader 350 may be formed into one piece for all four colors of the solid ink 390. One advantage of this integrated loader embodiment is that a user can carry away the integrated loader 350 more conveniently for replacement, maintenance, etc. Thus, the loader 350 and/or loaders 350C, 350M, 350Y and 350K can be detachable and/or disposable in other aspects.

As described above, according to aspects of the solid ink jet image forming apparatus of the present invention, the user loads the solid ink from the lateral side of the printing unit so that the solid ink can be simply and easily loaded into the image forming apparatus. Furthermore, if the solid ink jet image forming apparatus is provided with a scanning unit, the user can load the solid ink without needing to move the scanning unit, so that the solid ink jet image forming apparatus has improved installation stability and a more compact size than the conventional solid ink jet image forming apparatus. Additionally, the solid ink may be formed into units having different shapes corresponding to different colors of the units, and the loaders may have insertion holes corresponding to the different shapes of the different units, thus allowing the user to easily load the correct color ink into the correct insertion hole in a simple, quick and convenient fashion.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A solid ink jet image forming apparatus comprising:

a printing unit which fires melted ink onto a printing medium to print an image;

a scanning unit installed above a first side of the printing unit to scan data; and an ink supplying unit disposed under the scanning unit and accessible from a lateral side of the printing unit adjacent to the first side, wherein the ink supplying unit receives solid ink, melts the solid ink, and supplies the melted ink to the printing unit, and the ink supplying unit comprises a containing portion which contains at least one piece of the solid ink;

a heating plate which melts the solid ink; and a loader which reciprocates in a lateral direction of the printing unit to open the containing portion to allow the solid ink to be loaded into the containing portion, and to close the containing portion to bias the loaded solid ink against the heating plate.

2. The solid ink jet image forming apparatus of claim 1, wherein the ink supplying unit further comprises:

a supplying portion which supplies the melted ink to the printing unit; and a pressing plate located inside the loader which elastically presses the solid ink against the heating plate when the loader is inserted into the printing unit.

3. The solid ink jet image forming apparatus of claim 2, wherein the ink supplying unit further comprises an elastic member which supplies an elastic force to elastically bias the pressing plate toward the heating plate.

4. The solid ink jet image forming apparatus of claim 3, wherein the elastic member comprises a roll spring.

5. The solid ink jet image forming apparatus of claim 4, wherein the loader comprises an insertion hole through which the solid ink is loaded into the loader, wherein the insertion hole is shaped corresponding to a shape of the solid ink.

6. The solid ink jet image forming apparatus of claim 5, wherein the insertion hole is located on the loader at a predetermined position so that when the loader is pulled open to expose the insertion hole, the insertion hole is positioned to the side of the pressing plate.

7. The solid ink jet image forming apparatus of claim 2, wherein the solid ink comprises cyan, magenta, yellow, and black ink supplying units.

8. The solid ink jet image forming apparatus of claim 7, wherein the loader is formed in one piece to load the cyan, magenta, yellow, and black supplying units.

9. The solid ink jet image forming apparatus of claim 1, further comprising a door which closes and opens the lateral side of the printing unit to allow the loader to move inside and outside of the printing unit.

10. A solid ink jet image forming apparatus comprising:

a printing unit which fires melted ink onto a printing medium to print an image; and an ink supplying unit accessible from a lateral side of the printing unit and disposed between a top side and a bottom side of the printing unit, wherein the ink supplying unit receives solid ink, melts the solid ink and supplies the melted ink to the printing unit, and the ink supplying unit comprises a containing portion which contains at least one piece of the solid ink;

a heating plate which melts the solid ink; and a loader which reciprocates in a lateral direction of the printing unit to open the containing portion to allow the solid ink to be loaded into the containing portion, and to close the containing portion to bias the loaded solid ink against the heating plate.

11. The solid ink jet image forming apparatus of claim 10, wherein the ink supplying unit further comprises:

a supplying portion which supplies the melted ink to the printing unit; and a pressing plate located inside the loader which elastically presses the solid ink against the heating plate when the loader is inserted into the printing unit.

12. The solid ink jet image forming apparatus of claim 11, wherein the solid ink comprises cyan, magenta, yellow, and black ink supplying units.

13. The solid ink jet image forming apparatus of claim 10, wherein the loader comprises an insertion hole through which the solid ink is loaded into the loader, wherein the insertion hole is shaped corresponding to a shape of the solid ink.

14. A solid ink jet image forming apparatus comprising:

a printing unit which fires melted ink onto a printing medium to print an image;

a scanning unit installed on a first side of the printing unit to scan data; and an ink supplying unit which moves in and out of the solid inkjet image forming apparatus in a direction which does not pass through the first side on which the scanning unit is installed, wherein the ink supplying unit is disposed underneath the scanning unit and the direction is substantially parallel to a scanning direction of the scanning unit, and the ink supplying unit comprises a containing portion which contains at least one piece of solid ink;

a heating plate which melts the solid ink; and a loader which reciprocates in a lateral direction of the printing unit to open the containing portion to allow the solid ink to be loaded into the containing portion, and to close the containing portion to bias the loaded solid ink against the heating plate.

15. The solid ink jet image forming apparatus of claim 14, wherein the ink supplying unit further comprises:

a supplying portion which supplies the melted ink to the printing unit; and a pressing plate located inside the loader which elastically presses the solid ink against the heating plate when the loader is inserted into the printing unit.

16. The solid ink jet image forming apparatus of claim 15, wherein the ink supplying unit further comprises an elastic member which supplies an elastic force to elastically bias the pressing plate toward the heating plate.

17. The solid ink jet image forming apparatus of claim 16, wherein the elastic member comprises a roll spring.

18. The solid ink jet image forming apparatus of claim 17, wherein:

the loader comprises an insertion hole through which the solid ink is loaded into the loader; and the insertion hole is shaped corresponding to a shape of the solid ink.

19. The solid ink jet image forming apparatus of claim 18, wherein the insertion hole is located in the loader at a predetermined position so that when the loader is pulled open to expose the insertion hole, the insertion hole is positioned to the side of the pressing plate.

20. The solid ink jet image forming apparatus of claim 15, wherein the solid ink comprises cyan, magenta, yellow, and black ink supplying units.

21. The solid ink jet image forming apparatus of claim 20, wherein the loader is formed in one piece to load the cyan, magenta, yellow, and black supplying units.

22. An ink supplying unit to supply ink to a printing unit, comprising:

a containing portion which contains solid ink;

a heating plate which melts the solid ink; and a loader which reciprocates in a lateral direction of the printing unit, through a lateral side of the printing unit located between a top side and a bottom side of the printing unit, to open the containing portion to allow the solid ink to be loaded into the containing portion and close the containing portion to bias the loaded solid ink against the heating plate.

23. The ink supplying unit of claim 22, further comprising:

a supplying portion which supplies the melted ink to the printing unit; and a pressing plate located inside the loader which elastically presses the solid ink against the heating plate when the loader is inserted into the printing unit.

24. The ink supplying unit of claim 23, further comprising an elastic member which supplies an elastic force to elastically bias the pressing plate toward the heating plate.

25. The ink supplying unit of claim 24, wherein the elastic member comprises a roll spring.

26. The ink supplying unit of claim 25, wherein the solid ink comprises cyan, magenta, yellow, and black ink supplying units.

27. The ink supplying unit of claim 26, wherein the loader comprises an insertion hole through which the solid ink is loaded into the loader, wherein the insertion hole is shaped corresponding to a shape of the solid ink.

28. The ink supplying unit of claim 27, wherein the insertion holes are located on the loaders at predetermined positions so that when the loaders are pulled open to expose the insertion holes, the insertion holes are positioned to the side of the pressing plate.

29. The ink supplying unit of claim 28, further comprising a plurality of loaders formed in one piece to load cyan, magenta, yellow, and black ink supplying units.

* * * * *